United States Patent [19]

Svenka et al.

[11] Patent Number: 4,852,209

[45] Date of Patent: Aug. 1, 1989

[54] APPARATUS FOR CLEANING CALENDER ROLLS AND THE LIKE

[75] Inventors: Peter Svenka, Grefarth; Richard Rauf, Krefeld-Oppum, both of Fed. Rep. of Germany

[73] Assignee: Kleinewefers GmbH, Krefeld, Fed. Rep. of Germany

[21] Appl. No.: 195,108

[22] Filed: May 16, 1988

[30] Foreign Application Priority Data

May 20, 1987 [DE] Fed. Rep. of Germany ..... 3716902

[51] Int. Cl.[4] ..... B21B 28/02

[52] U.S. Cl. ..... 15/308; 15/256.52; 15/319; 15/339; 15/345

[58] Field of Search ..... 15/308, 256.51, 256.52, 15/302, 319, 306 A, 345, 339

[56] References Cited

U.S. PATENT DOCUMENTS

| | | | |
|---|---|---|---|
| 2,651,080 | 9/1953 | Wied | 15/345 X |
| 3,453,674 | 7/1969 | Comber et al. | 15/302 X |
| 3,737,940 | 6/1973 | Moestue et al. | 15/308 X |
| 3,952,361 | 4/1976 | Wilkins | 15/319 |
| 3,974,540 | 8/1976 | Bonner | 15/339 |
| 4,133,073 | 1/1979 | Marzoli | 15/308 |

*Primary Examiner*—Chris K. Moore

*Attorney, Agent, or Firm*—Peter K. Kontler

[57] ABSTRACT

Apparatus for intermittently removing impurities from the periphery of a calender roll includes a rotary cleaning implement in the form of a brush or several felt discs and having an axial length in the range of 5–10 cm. The cleaning implement is reciprocable longitudinally of the roll along a suitable guide and can be driven back and forth by a motor so as to remove impurities which are detected by a mobile monitoring device. The latter can be mounted in or on a frame for the cleaning implement or is movable along the roll independently of the cleaning implement. The apparatus can be mounted at the inlet or outlet side of the nip of the calender roll with a companion roll. The frame for the cleaning implement can carry one or more nozzles which direct water or another liquid (such as a solvent) against the cleaning implement and/or against the roll, and one or more nozzles which blow jets of air against the periphery of the roll.

23 Claims, 2 Drawing Sheets

APPARATUS FOR CLEANING CALENDER ROLLS AND THE LIKE

The invention relates to improvements in apparatus for cleaning rolls which can be utilized in calenders, glazing machines and similar machines wherein two or more elongated driven rolls define one or more nips for webs of paper, metallic or plastic foil, textile material and/or other sheet or strip-like commodities which are treated as a result of the application of heat and/or pressure during travel through the nip or nips.

The rolls of calenders and similar machines often accumulate impurities which must be removed from their peripheral surfaces in order to ensure that the web which is conveyed through the nip or nips will be subjected to a predictable treatment and will exhibit desirable characteristics after it leaves the machine.

German Utility Model No. 1,928,850 of Billhöfer discloses an apparatus which is designed to clean the periphery of an elongated roll in a calendar, dryer or a like machine. The cleaning apparatus comprises an elongated roller having a length which matches the length of the roll to be cleaned and carrying at least one helically convoluted cleaning band which surrounds its peripheral surface. The roller can be moved radially toward engagement with and away from the peripheral surface of the rotating roll. A drawback of such cleaning apparatus is that not only the calendar roll but also the roller undergoes extensive wear because such parts are in contact the full length of the roll when the cleaning apparatus is in use. In other words, the cleaning band which is convoluted around the peripheral surface of the roller will rub against the entire peripheral surface of the roll even if only a small portion of the peripheral surface of the roll necessitates cleaning. Moreover, the cleaning apparatus is complex, bulky and expensive, especially if it is designed to clean rolls having a length of several meters.

The just discussed German Utility Model further discloses the possibility of employing an elongated rail-shaped scraper or a cleaning roller which consists of a plurality of neighboring discs of the type often used in floor sweeping and like machines. The discs are separated from each other by distancing elements in the form of additional discs which not only rotate about the axis of such composite cleaning roller but also perform axial back-and-forth movements.

German Pat. No. 3,428,388 to Küsters discloses a modified cleaning apparatus wherein a scraper blade extends the full length of the roll to be cleaned and is located immediately behind a manifold which discharges steam against the peripheral surface of the calendar roll. The arrangement is such that the manifold discharges steam only against that portion or those portions of the peripheral surface of the calendar roll which necessitate cleaning.

German Auslegeschrift No. 1,461,123 of Küsters discloses a cleaning apparatus which employs a discrete brush for each of the calender rolls to be cleaned. Each such brush extends the full length of the respective roll and cooperates with a device which strips impurities from its peripheral surface. Each stripping device acts not unlike a rake which relieves the respective brush of impurities downstream of the location where the brush contacts the periphery of the respective roll. A drawback of such apparatus is that the cost is prohibitive when the calendar rolls are long and the machine employs a plurality of calender rolls because a separate elongated brush and a separate stripping device must be provided for each roll, together with means for rotating the brushes and with means for moving the brushes relative to the respective rolls.

U.S. Pat. No. 3,840,933 to Schwab et al. discloses a roller scraping apparatus which can be utilized to simultaneously scrape a pair of rollers in a paper mill. The apparatus employs two pairs of scrapers, one pair for each roller, and a hydraulic or mechanical system for moving the carriers of the two pairs of scrapers apart so that the scrapers of each pair bear against the peripheral surface of the respective roller. A handle is provided to shift the carriers for the pairs of scrapers longitudinally of the rolls. A drawback of such cleaning apparatus is that it cannot be readily used for the cleaning of a single roll and also that it is cumbersome, time consuming and tiresome for a person to manually operate the apparatus, especially if the rolls to be scraped are relatively long.

OBJECTS AND SUMMARY OF THE INVENTION

An object of the invention is to provide a novel and improved apparatus which can clean selected portions of a calender roll or a like roll with little loss in time, with little wear upon the roll and, if necessary, in a fully automatic way.

Another object of the invention is to provide novel and improved cleaning implements for use in the above outlined apparatus.

A further object of the invention is to provide the apparatus with novel and improved means for facilitating removal of impurities from the peripheral surface of a rotary calender roll.

An additional object of the invention is to provide the apparatus with novel and improved means for automatically gathering the removed impurities.

Still another object of the invention is to provide the apparatus with novel and improved means for reliably detecting the impurities at the periphery of a calender roll.

A further object of the invention is to provide the apparatus with novel and improved means for guiding the cleaning implement toward engagement with selected portions of the roll to be cleaned.

An additional object of the invention is to provide novel and improved means for expelling from the peripheral surface of the calender roll those impurities which are loosened by the above outlined apparatus.

The invention resides in the provision of an apparatus for intermittently cleaning a roll having a predetermined length and being utilized in calenders and like machines. The apparatus comprises a rotary cleaning implement having an axial length which is a small or minute fraction of the predetermined length of the roll to be cleaned, and guide means movably supporting the cleaning implement and extending in parallelism with the roll so that the cleaning implement can be moved into cleaning engagement with axially spaced-apart portions of the periphery of the roll.

The apparatus can further comprise means for moving the guide means and the cleaning implement substantially radially of the implement so as to place the latter into engagement with or to move it away from the roll.

The axial length of the cleaning implement need not exceed 10 cm, i.e., it can be less than 11 cm. In many instances, it suffices to employ a cleaning implement having an axial length in the range of 4–6 cm, preferably approximately 5 cm.

The cleaning implement can include at least one rotary brush or at least one rotary disc. For example, the cleaning implement can include a plurality of discs at least one of which contains felt, and such apparatus can further comprise means for loosely mounting the discs for rotation about a common axis.

As a rule, the roll to be cleaned cooperates with a second roll and defines with the second roll a nip having an inlet side for admission of a material to be treated during advancement through the nip and an outlet side. The cleaning implement can be disposed at the inlet side or at the outlet side of the nip of such rolls.

The apparatus preferably further comprises a frame which carries the cleaning implement and is movable with the cleaning implement along the guide means. Furthermore, the apparatus can comprise at least one wetting or moistening device which is preferably mounted on the frame. Such wetting device can comprise means for directing a liquid (such as water, a solvent or a softening agent) against the cleaning implement and/or against the periphery of the roll. Each liquid directing means can comprise at least one spray nozzle.

The frame can further support a hood which partially surrounds the cleaning implement and serves to intercept impurities which are removed from the roll. Means can be provided for evacuating impurities from the hood; for example, such evacuating means can include a suction generating device which draws impurities from the interior of the hood.

The roll can be caused to rotate in a predetermined direction in the course of the cleaning operation. The frame for the cleaning implement can further carry means for blowing a gaseous fluid against the peripheral surface of the roll. Such blowing means can be located past the frame as seen in the direction of rotation of the roll, and can serve to expel impurities which were loosened by the cleaning implement but continue to adhere to the peripheral surface of the roll. The apparatus can further comprise means for admitting a liquid into the gaseous fluid which is discharged by the blowing means. For example, the blowing means can comprise one or more atomizers which discharge one or more sprays of atomized solvent and air against the peripheral surface of the roll downstream of the cleaning implement.

A doctor or a similar device can be provided on the frame to repel impurities from the cleaning implement so that the implement can continuously remove fresh impurities from the peripheral surface of the roll without delivering already removed impurities back to the peripheral surface of the roll.

The apparatus can further comprise means for monitoring the periphery of the roll for the presence of impurities, and means for moving the monitoring means longitudinally of the roll. The means for moving the monitoring means can include the aforementioned frame for the cleaning implement. Alternatively, the apparatus can comprise discrete means for guiding and moving the monitoring means longitudinally of the roll, i.e., independently of the cleaning implement.

The monitoring means preferably includes means for generating signals which denote the presence of impurities, and such signals can be utilized to operate a motor which moves the cleaning implement and its frame along the guide means on to the detected locus of impurities so that the cleaning implement will rapidly remove those impurities which have been detected by the monitoring means. The monitoring means can comprise means for detecting colored impurities and/or means for monitoring the temperature of the roll. Changes of roll temperature are often indicative of the presence of impurities on the respective portion of the peripheral surface of the roll.

The novel features which are considered as characteristic of the invention are set forth in particular in the appended claims. The improved cleaning apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
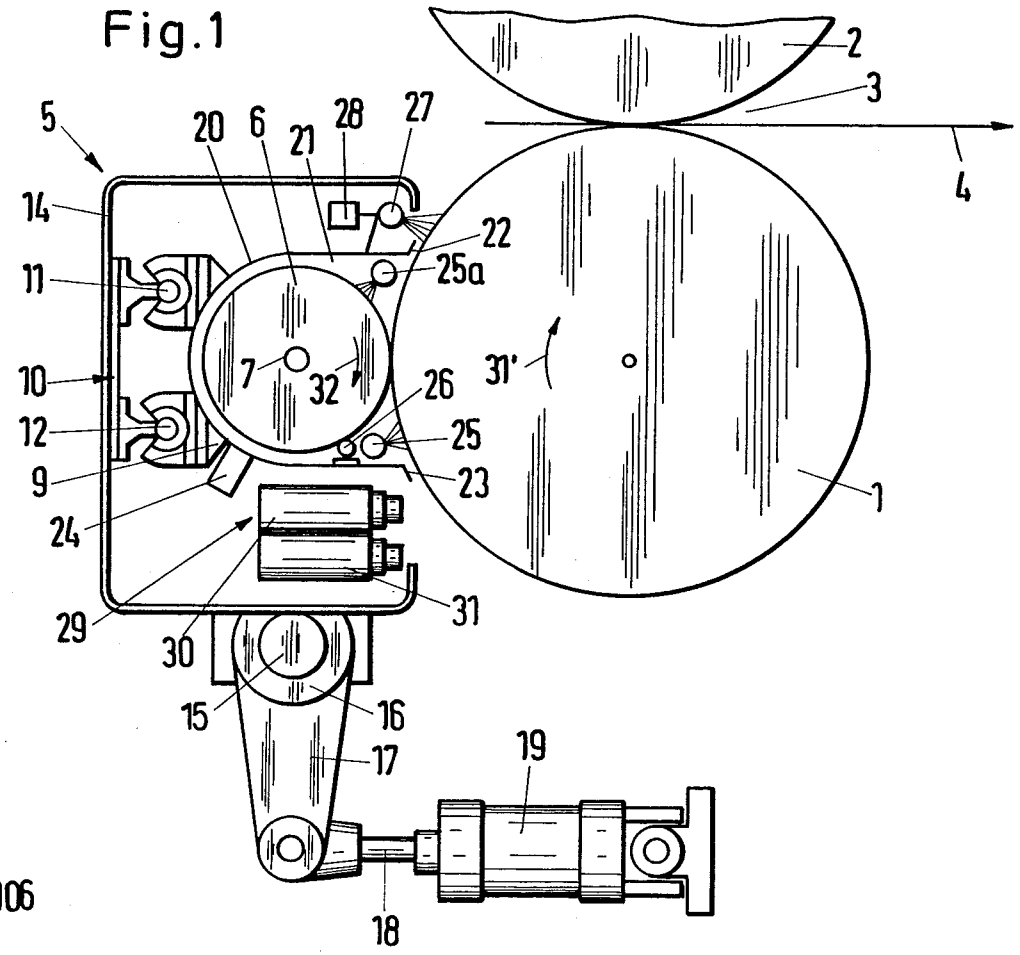
FIG. 1 is a schematic end elevational view of two calender rolls and of an apparatus which serves to clean one of the rolls and is constructed and assembled in accordance with one embodiment of the present invention.
Figure 2:
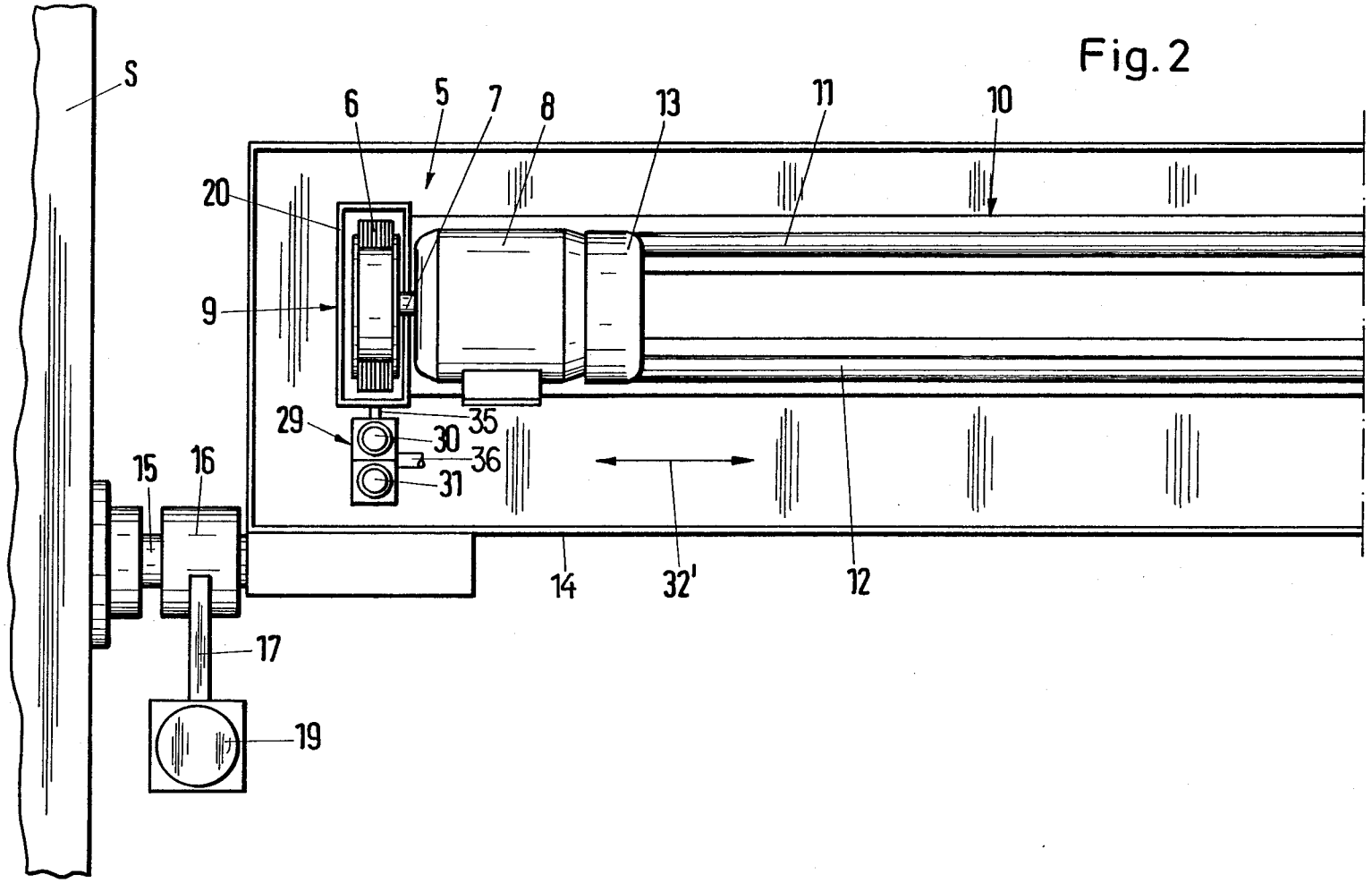
FIG. 2 is a fragmentary front elevational view of the apparatus as seen from the right-hand side of FIG. 1, with the rolls omitted.

Referring first to FIGS. 1 and 2, there is shown a portion of a calender including a first elongated roll 1 and a second elongated roll 2. The rolls define a nip 3 for a running web 4 of material which necessitates treatment during travel through the nip. Such treatment can involve the application of pressure with or without heating or cooling. The web 4 can consist of or can contain paper, a textile material, a metallic or plastic foil or a combination of two or more different materials.

The roll 1 is preferably elastic, i.e., it can contain an outer layer of cotton or an outer layer of a suitable plastic material. Such types of rolls are utilized when the web 4 is a paper web. However, it is equally possible to employ a roll 1 which has an outer layer or shell of steel or another metallic material; such rolls are often used for the calendering of magnetic bands.

In accordance with the invention, the calender which includes the rolls 1 and 2 further comprises a novel and improved cleaning apparatus 5 with a relatively narrow rotary cleaning implement 6 which can consist of or comprise a plurality of felt discs. For example, the axial length of the roll 1 can be several meters whereas the axial length of the cleaning implement 6 need not exceed 10 cm. By way of example, the axial length of the illustrated cleaning implement 6 can be in the range of 5 cm. The means for rotating the cleaning implement 6 about an axis which is parallel to the axis of the roll 1 to be cleaned comprises an electric motor 8 having an output shaft 7 which carries the implement 6. The motor 8 is mounted in a frame 9 which, in turn, is movably mounted on a guide means 10 including two elongated rod-shaped guide members 11, 12 extending in parallelism with the axis of the roll 1. The frame 9 can be shifted longitudinally of the guide members 11, 12 by hand in directions which are indicated by a double-headed arrow 32', or by a transmission 13 which is driven by the motor 8 and can rotate one or more friction wheels (not specifically shown) or other suitable elements which compel the motor 8 and the frame to move along the guide means 10 toward a selected position adjacent the peripheral surface of the roll 1. Alternatively, the motor 8 can drive one or more pinions mating with stationary toothed racks (not shown) which are affixed to or form part of the guide members 11, 12.

The guide means 10 is mounted in a housing 14 which is movable radially of the cleaning implement 6 and roll 1 toward and away from the position of FIG. 1 in which the peripheral surface of the cleaning implement 6 contacts the peripheral surface of the roll 1. To this end, the housing 14 is rigid with a sleeve 16 which is turnably mounted on a stationary shaft 15. The sleeve 16 is rigid with a link 17 which can be rocked back and forth by the piston rod 18 of a fluid-operated motor 19. The frame 9 with the motor 8 and cleaning implement 6 is movable along the guide members 11, 12 which are secured to the housing 14. When the cleaning operation is completed, the motor 19 retracts the piston rod 18 so that the link 17 moves the housing 14 in a direction to the left, as seen in FIG. 1, in order to move the cleaning implement 6 away from the peripheral surface of the roll 1. The shaft 15 is mounted in the frame S of the machine which employs the rolls 1 and 2. The motor 19 can constitute a hydraulic cylinder and piston unit which is employed to rock the link 17 for the purpose of moving the cleaning implement 6 toward or away from engagement with the peripheral surface of the roll 1 as well as to apply to the cleaning implement 6 a force which is necessary to remove impurities from the peripheral surface of the roll 1 when the cleaning apparatus 5 is in actual use.

The frame 9 further supports a hood 20 which partially surrounds the cleaning implement 6. The internal space 21 of the hood is at least partially sealed from the surrounding atmosphere by sealing strips 22, 23 which are disposed at the ends of the hood 20 at opposite sides of the cleaning implement 6 and come close to or even in actual contact with the peripheral surface of the roll 1 when the apparatus 5 is in actual use. The reference character 24 denotes in FIG. 1 a suction-operated evacuating device which is used to withdraw impurities from the internal space 21 of the hood 20 when the apparatus 5 is in actual use or subsequent to each use.

The cleaning apparatus 5 further comprises a composite wetting device which includes a first nozzle 25 having one or more orifices which spray a liquid against the peripheral surface of the roll 1, and a second nozzle **25*a* which sprays a liquid against the periphery of the cleaning implement 6. The nozzles 25 and 25*a* can be mounted in the frame 9 or in the hood 20. The liquid which is discharged by the nozzles 25, 25*a* can be water, a solvent for the matter which has accumulated on the peripheral surface of the roll 1 and is to be removed by the cleaning implement 6, or any other liquid substance which promotes the removal of impurities from the roll 1. The nozzles 25 and 25*a* are preferably atomizing nozzles so that they discharge fine sprays of liquid against the roll 1 and cleaning implement 6**, respectively.

The internal space 21 of the hood 20 further accommodates a doctor 26 or an analogous stripping device which engages the peripheral surface of the cleaning implement 6 and relieves it of impurities so that such impurities leave the cleaning implement and can be readily withdrawn from the internal space 21 by the evacuating means 24. The nozzles **25, 25*a*, or at least the nozzle 25, can discharge a solvent when the machine including the rolls 1, 2 is designed to treat magnetic bands or the like. The doctor 26 can simply repel impurities from the peripheral surface of the cleaning implement 6** or it can include or constitute a rake or an analogous tool which scrapes the impurities off the periphery of the rotating cleaning implement.

The housing 14 or the hood 20 supports a device 27 which blows one or more jets of air or another gaseous fluid against the peripheral surface of the roll 1 downstream of the sealing lip 22 of the hood 20. If desired, the blowing device 27 can be combined with a source of liquid (shown at 28) which can admit metered quantities of a suitable liquid into the jets of compressed air or another gaseous fluid so that the orifice or orifices of the blowing device 27 direct against the roll 1 one or more sprays of finely atomized liquid. The jet or jets which issue from the device 27 can be used to cool the roll 1 as well as to remove from the peripheral surface of the roll 1 those impurities which are loosened by the cleaning implement 6 but continue to adhere to the peripheral surface of the roll 1. The arrow 31' denotes the direction of rotation of the roll 1, and the arrow 32 denotes the direction of rotation of the cleaning implement 6. It will be noted that the contacting portions of the roll 1 and cleaning implement 6 rotate in opposite directions. This is desirable and advantageous because the relative velocity of such contacting portions of the two peripheral surfaces is higher.

The cleaning apparatus 5 further comprises means 29 for monitoring the peripheral surface of the roll 1 in order to detect the presence or absence of impurities which are thereupon removed by the cleaning implement 6. The illustrated monitoring means 29 comprises a detector 30 of colored matter and a detector 31 which monitors the temperature of the periphery of the roll 1. The entire monitoring means 29 can be mounted (at 35) on the frame 9 for the motor 8. However, it is equally within the purview of the invention to provide the cleaning apparatus 5 with separate means (36) for guiding and moving the monitoring means 29 longitudinally of the roll 1 independently of the frame 9 for the cleaning implement 6 and its motor 8. This is often desirable and advantageous because the monitoring means 29 can be set in motion while the motor 8 is idle. If the monitoring means 29 does not detect any impurities, the cleaning implement 6 need not be rotated and can remain out of contact with the peripheral surface of the roll 1 to thus avoid unnecessary wear and unnecessary consumption of energy. The signals which are generated by the detector 30 and/or 31 are transmitted to the motor 8 in a manner not forming part of the present invention but well known from the art so that such detectors can initiate a movement of the cleaning implement 6 to the locus where the peripheral surface of the roll 1 necessitates cleaning. Signals from the monitoring means 29 can further initiate starting of the motor 8 to rotate the cleaning implement 6 as well as an actuation of the motor 19 in order to move the housing 14 to the position of FIG. 1 in which the cleaning implement 6 comes into actual contact with the periphery of the roll 1 at the locus of the detected impurity or impurities. Means for moving temperature detectors longitudinally of a calender roll are well known in the art. Reference may be had, for example, to commonly owned U.S. Pat. No. 4,498,383 granted Feb. 12, 1985 to Josef Pav et al.

The moving means 36 is uncoupled from the monitoring means 29 when the latter is reciprocated by the moving means 9, 35 and vice versa.

When the cleaning apparatus 5 is to be put to use, the motor of the calender drives the roll 1 in the direction of the arrow 31'. The motor 8 for the cleaning implement 6 is started not later than when the cleaning implement moves into register with that portion of the peripheral surface of the roll 1 which necessitates cleaning, and the motor 19 is then actuated to move the housing 14 to the position of FIG. 1 so that the roll 1 is engaged by the cleaning implement 6. As stated above, those portions of the peripheral surfaces of the roll 1 and cleaning implement 6 which contact each other rotate in opposite directions in order to increase the relative velocity and to enhance the cleaning action. The nozzles 25 and **25*a* are preferably designed to apply atomized sprays of liquid to the periphery of the roll 1 and to the periphery of the cleaning implement 6 immediately prior to the instant when the respective portions of the peripheral surface of the rotating cleaning implement 6 engage the freshly wetted portions of the peripheral surface of the roll 1. The doctor 26 is located downstream of the locus of contact between the peripheral surfaces of the roll 1 and cleaning implement 6 so as to immediately remove those impurities which were taken off the peripheral surface of the roll 1. Such impurities are then extracted from the internal space 21 of the hood 20 by the evacuating device 24. The purpose of the evacuating device 24 is to enable the cleaning implement 6 to remove impurities at a predictable rate, as well as to prevent removed impurities from again contaminating the peripheral surface of the roll 1 and/or from reaching the web 4**.

Figure 3:
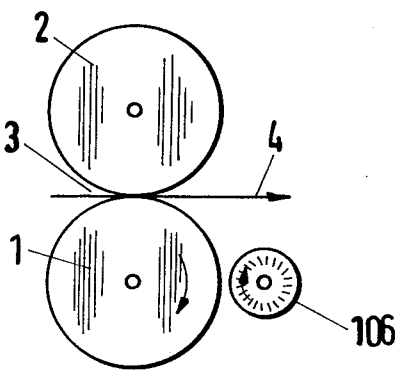
FIG. 3 is a schematic end elevational view of two calender rolls and of a modified cleaning implement which is disposed at the outlet side of the nip of the rolls.

FIG. 3 shows two calender rolls 1, 2 which define nip 3 for a running web 4. The roll 1 rotates in a clockwise direction and the cleaning apparatus includes a cleaning implement 106 which can constitute a rotary brush and is located at the outlet side of the nip 3, namely at that side where successive increments of the treated web 4 advance beyond the rolls 1 and 2. FIG. 3 shows the brush-shaped cleaning implement 106 in an inoperative position in which the peripheral surface of this cleaning implement is spaced apart from the peripheral surface of the roll 1. An advantage of placing the cleaning implement 106 at the outlet side of the nip 3 is that such arrangement further reduces the likelihood of recontamination of the roll 1 and the likelihood of the impurities reaching the freshly treated increments of the web 4. Moreover, and if the periphery of the roll 1 and/or cleaning implement 106 is wetted (such as by the nozzles 25, **25*a* of FIG. 1) in the region where the cleaning implement engages the periphery of the roll 1, the freshly wetted and cleaned portions of the peripheral surface of the roll 1 must travel a considerable distance on their way toward contact with the web 4 so that the liquid which was applied by the nozzle 25 and/or 25*a* can evaporate and does not reach the web 4. Of course, it is also possible to provide means for drying the periphery of the roll 1 and the periphery of the cleaning implement 6 or 106 if such drying operation is necessary in view of extensive or pronounced wetting of the part 1 and/or 6 and/or 106** in the region where the cleaning operation takes place.

An important advantage of the improved cleaning apparatus is that the cleaning implement 6 or 106 can be caused to engage and treat a selected portion of the peripheral surface of the roll 1 with a substantial force. This is due to the fact that the area of contact between the cleaning implement and the roll 1 is very small, irrespective of the length of the roll. Moreover, it is simpler and easier to ensure that the cleaning implement bears against the peripheral surface of the roll 1 with a predetermined optimum force if the cleaning apparatus employs a short cleaning implement. Such selection of a predetermined optimum force is not possible if the length of the cleaning implement equals or approximates the length of the roll in a calender or a like machine, especially if the roll has a deformable shell which is often used in calenders and like machines. Reference may be had to commonly owned U.S. Pat No. 4,389,932 granted Jun. 28, 1983 to Josef Pav.

Another important advantage of the improved cleaning apparatus is that it does not cause extensive wear upon the roll which necessitates cleaning. This is due to the fact that the cleaning implement 6 or 106 can be readily and rapidly moved into contact only with that portion of the peripheral surface of the roll 1 which necessitates cleaning or a similar treatment. As a rule, contaminations at the periphery of a calender roll are highly localized so that it is not necessary to have a relatively long cleaning implement in order to remove such contaminations. For example, a piece of paper may adhere to a portion of the peripheral surface of the roll 1 or fragments of material in the case of coated or imprinted papers which are likely to deposit relatively narrow rings of coating material on the calender roll. In the case of magnetic bands, relatively narrow bands are likely or apt to adhere to the calender roll.

Satisfactory results were obtained with cleaning implements which comprise ten felt discs (see FIG. 2) disposed side by side and each having a thickness of approximately 5 mm.

The apparatus which embodies the cleaning implement 106 of FIG. 3 exhibits the additional advantage that it can remove impurities immediately downstream of the nip 3. Thus, if the web 4 which is shown in FIG. 3 carries one or more coats of coloring matter or other material which is likely to deposit on the periphery of the roll 1, such material is removed by the cleaning implement 106 before it hardens or incrustates on the periphery of the roll 1 which is often heated in order to produce a desired effect. It is not unusual that the rolls which define the nip 3 are maintained at a relatively high temperature. As mentioned above, the apparatus of FIG. 3 can also employ means for applying sprays of water, solvent, steam or any other substance which will promote and facilitate separation of contaminants from the peripheral surface of the roll 1. The wetting device or devices and/or the blowing device or devices can be designed and mounted to direct a liquid and/or a gaseous fluid only against that portion of the peripheral surface of the roll 1 which is being treated or is about to be treated by the peripheral surface of the cleaning implement 6 or 106.

The hood 20 can constitute or form part of the means which must be provided in certain types of calenders and like machines to reduce the likelihood of explosion, especially if the web 4 carries or is contacted by highly volatile solvents. Such solvents are used in connection with the treatment of magnetic tapes. The evacuating device 24 assists in reducing the danger of explosion by rapidly evacuating solvents which might evaporate in the internal space 21 of the hood 20. Means for protecting against explosion must or should be installed between the hood 20 and the roll 1 if the machine is designed or used to treat magnetic tapes.

The blowing device 27 constitutes an optional but desirable feature of the improved cleaning apparatus. Such device is particularly advantageous if the roll 1 is heated and has an elastic peripheral layer which is likely to be heated to an excessive temperature. The temperature of the fluid which is discharged by the blowing device 27 can be readily maintained at a value such that it reduces the temperature of the adjacent portion of the roll 1 before such portion reaches the nip 3. Furthermore, and if the cleaning apparatus employs one or more wetting devices, such as the nozzles 25 and 25*a* of FIG. 1, the jet or jets of gaseous fluid which are discharged by the blowing device 27 can ensure and promote rapid drying and evaporation of the liquid or liquids which are discharged by the nozzles 25, 25*a* before the respective portions of the peripheral surface of the roll 1 enter the nip 3. If the cooling action is the more important feature of the blowing device 27, the source 28 can discharge cold water which is mixed with compressed air or with another gaseous coolant and is caused to contact successive increments of the selected annular part of the peripheral surface of the roll 1.

The monitoring means 29 also constitutes an optional feature of the improved cleaning apparatus. For example, a person standing next to the roll 1 can observe and readily detect those portions of the peripheral surface of this roll which necessitate cleaning. The frame 9 is thereupon shifted by hand or by the motor 8 so as to move the cleaning implement 6 to a position of register with that portion of the peripheral surface which necessitates cleaning or a similar treatment. However, the monitoring means 29 is preferred in many modern calenders and like machines because it renders it possible to dispense with visual observation of the roll 1, especially if the signals from the detectors 30 and 31 are employed to actuate the motors 8 and 19 in a proper sequence so that the cleaning implement 6 or 106 can be automatically moved to an optimum position, as seen in the axial direction of the roll 1, in order to immediately remove impurities from the freshly detected or pinpointed portion of the peripheral surface of the roll 1. The utilization of monitoring means 29 and of an operative connection between the signal generating components 30, 31 of such monitoring means and the motors 8 and 19 is desirable on the additional ground that the monitoring means can be continuously reciprocated (by 36) back and forth between the axial ends of the roll 1 to practically immediately ascertain the presence of impurities which necessitate removal so that such impurities cannot harden or incrustate at the periphery of the roll 1 but are removed practically immediately upon development and detection. As mentioned above, the roll 1 often necessitates extensive heating so that any impurities in the form of viscous substances or the like are likely to harden shortly after they are deposited at the periphery of the roll 1, either by the associated roll 2 or by the running web 4.

If the monitoring means 29 is mounted (at 35) in or on the frame 9 and/or in or on the hood 20, it can share the movements of the cleaning implement 6 or vice versa. Thus, if a monitoring means which is mounted on the frame 9 is caused to continuously move back and forth between the axial ends of the roll 1 in order to rapidly detect any freshly developing impurities, it can generate a signal which deactivates the transmission 13 so that the motor 8 continues to rotate the cleaning implement 6 but permits the cleaning implement to remain in a selected position along the roll 1. The motor 19 is then actuated to cause the housing 14 to move the cleaning implement 6 into contact with the peripheral surface of the roll 1 to bring about practically instantaneous removal of freshly detected impurities. The monitoring means 29 can continue to monitor the adjacent portion of the periphery of the roll 1 and can generate a signal as soon as the impurity is no longer present. Such signal causes the motor 19 to disengage the cleaning implement 6 from the roll 1.

An advantage of the provision of separate means (36) for moving the monitoring means 29 along the roll 1 independently of the frame 9 for the cleaning implement 6 is that the monitoring means 29 can continue to seek out freshly developing impurities while the cleaning implement 6 is in the process of removing previously detected impurities from the corresponding portion of the roll 1. Consequently, the cleaning implement 6 can be moved to a position to remove a freshly discovered impurity as soon as it has completed the removal of the previously detected impurity or impurities. Such mode of moving the monitoring means 29 independently of the cleaning implement 6 contributes to a further reduction of the intervals during which the impurities are permitted to adhere to the peripheral surface of the roll 1.

Still another advantage of mounting the monitoring means 29 for movement independently of the frame 9 for the cleaning implement 6 or 106 is that the mass of the moving parts when the detectors 30, 31 move relative to the cleaning implement 6, its motor 8 and its frame 9 is relatively small. In other words, the bulk of the cleaning apparatus 5 (including the cleaning implement 6, the motor 8 and the frame 9) will be set in motion longitudinally of the roll 1 only if and when the monitoring means 29 detects an impurity.

It is further possible to operate the motor 8 in such a way that it rotates the cleaning implement 6 for a fixed interval of time as soon as the cleaning implement reaches a selected position in the axial direction of the roll 1. After the elapse of such interval of time, the monitoring means 29 can inspect the freshly cleaned portion of the periphery of the roll 1 and transmit a signal which initiates a renewed cleaning operation if the preceding cleaning operation did not suffice to complete the removal of the impurity or impurities. If the impurity or impurities are not removed after a selected number of successive cleaning operations, the monitoring means 29 can transmit a signal which will alert the attendants and/or arrest the motor or motors which rotate the rolls of the calender.

An advantage of a monitoring means which employs a color-sensitive detector 30 is that such detector can readily detect frequently occurring impurities whose color deviates from the color of the peripheral surface of the roll 1. It is customary to coat the peripheral surface of the roll with a layer of a particular color, especially if the roll 1 has an elastic outer layer. The temperature-responsive detector 31 is desirable and advantageous, especially if the roll 1 has an elastic coating. An elastic coat is likely to undergo localized overheating, especially in those regions which carry contaminants. Furthermore, the detector 31 need not necessarily serve to transmit signals for operation of the cleaning apparatus 5. Thus, such temperature-responsive detector can be used for other purposes in a calender or a like machine, for example, to control the temperature of the roll 1 in a manner which is well known from the art. Reference may be had to the aforementioned U.S. Pat. No. 4,498,383. In other words, a single carriage (36) for the detectors 30 and 31 suffices to move such detectors longitudinally of the roll 1 so that the detector 30 can transmit signals which control the operation of the cleaning apparatus while the detector 31 transmits signals which serve other purposes, such as regulating the temperature along the nip 3 as well as to regulate the operation of the cleaning apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for intermittently removing impurities from a roll having a predetermined length and arranged to rotate in a predetermined direction, and being utilized in calenders and like machines, comprising a rotary cleaning implement having an axial length which is a small fraction of said predetermined length; guide means movable supporting the cleaning implement and extending in parallelism with the roll so that the cleaning implement can be moved into cleaning engagement with axially spaced-apart portions of the periphery of the roll; a frame for said cleaning implement movable along said guide means; and means for blowing a gaseous fluid against the roll, said blowing means being located past said frame as seen in the direction of rotation of the roll.

2. The apparatus of claim 1, further comprising means for admitting a liquid into the gaseous fluid which is discharged by said blowing means.

3. Apparatus for intermittently removing impurities from a roll having a predetermined length and being utilized in calenders and like machines, comprising a rotary cleaning implement having an axial length which is a small fraction of said predetermined length; guide means movably supporting the cleaning implement and extending in parallelism with the roll so that the cleaning implement can be moved into cleaning engagement with axially spaced-apart portions of the periphery of the roll; means for monitoring the periphery of the roll for the presence of impurities; and means for moving said monitoring means longitudinally of the roll.

4. The apparatus of claim 3, further comprising means for moving the guide means and the cleaning implement substantially radially of the implement so as to place the cleaning implement into engagement with or to move the cleaning implement away from the roll.

5. The apparatus of claim 3, wherein the axial length of the cleaning implement is less than 11 cm.

6. The apparatus of claim 5, wherein the axial length of the cleaning implement is in the range of 4–6 cm.

7. The apparatus of claim 3, wherein said cleaning implement includes at least one rotary brush.

8. The apparatus of claim 3, wherein said cleaning implement includes at least one rotary disc.

9. The apparatus of claim 3, wherein said cleaning implement includes a plurality of discs at least one of which contains felt, and means for loosely mounting said discs.

10. The apparatus of claim 3 for intermittently cleaning a roll which cooperates with a second roll and defines therewith a nip having an inlet side for admission of a material to be treated during advancement through the nip and an outlet side, wherein said cleaning implement is disposed at the outlet side of the nip of the rolls.

11. The apparatus of claim 3, further comprising a frame for said cleaning implement, said frame being movable with the cleaning implement along said guide means; and further comprising a wetting device on said frame.

12. The apparatus of claim 11, wherein said wetting device comprises means for directing a liquid against the cleaning implement.

13. The apparatus of claim 11, wherein said wetting device comprises means for directing a liquid against the periphery of the roll.

14. The apparatus of claim 11, wherein said wetting device comprises at least one spray nozzle.

15. The apparatus of claim 3, further comprising a hood partially surrounding said cleaning implement and arranged to intercept impurities which are removed from the roll.

16. The apparatus of claim 15, further comprising means for evacuating impurities from said hood.

17. The apparatus of claim 3, further comprising means for repelling impurities from said cleaning implement.

18. The apparatus of claim 3, wherein said monitoring means includes means for generating signals denoting the presence of impurities; and further comprising means for moving said cleaning implement along said guide means to a position for removal of impurities which are detected by said monitoring means.

19. The apparatus of claim 3, further comprising a frame supporting said cleaning implement, said frame constituting or forming part of said means for moving the monitoring means longitudinally of the roll.

20. The apparatus of claim 3, further comprising a frame supporting said cleaning implement and movable along said guide means, said moving means including means for moving the monitoring means independently of said frame.

21. The apparatus of claim 20, further comprising means for moving the frame and the cleaning implement along said guide means to positions for removal of impurities which are detected by said monitoring means.

22. The apparatus of claim 3, wherein said monitoring means includes means for detecting colored impurities.

23. The apparatus of claim 3, wherein said monitoring means includes means for monitoring the temperature of the roll.

* * * * *